US006705893B1

(12) United States Patent
Ko

(10) Patent No.: US 6,705,893 B1
(45) Date of Patent: Mar. 16, 2004

(54) LOW PROFILE CABLE CONNECTOR ASSEMBLY WITH MULTI-PITCH CONTACTS

(75) Inventor: David Tso-Chin Ko, Thousand Oaks, CA (US)

(73) Assignee: Hon Hai Precision Ind. Co., Ltd., Tipei Hsien (TW)

( * ) Notice: Subject to any disclaimer, the term of this patent is extended or adjusted under 35 U.S.C. 154(b) by 0 days.

(21) Appl. No.: 10/235,289

(22) Filed: Sep. 4, 2002

(51) Int. Cl.[7] ..... H01R 13/648
(52) U.S. Cl. ..... 439/607; 439/497
(58) Field of Search ..... 439/497, 579, 439/607, 942

(56) References Cited

U.S. PATENT DOCUMENTS

| | | | | |
|---|---|---|---|---|
| 5,919,063 | A | * 7/1999 | Wang | 439/608 |
| 5,980,308 | A | * 11/1999 | Hu et al. | 439/497 |
| 6,039,611 | A | * 3/2000 | Yang | 439/701 |
| 6,123,582 | A | 9/2000 | Ko | |
| 6,139,363 | A | * 10/2000 | Ko et al. | 439/579 |
| 6,146,201 | A | * 11/2000 | Chen | 439/607 |
| 6,165,008 | A | * 12/2000 | Wu et al. | 439/492 |
| 6,171,134 | B1 | * 1/2001 | Lai | 439/405 |
| D444,130 | S | 6/2001 | Hayashi et al. | |
| 6,273,749 | B1 | * 8/2001 | Yang | 439/497 |
| 6,273,753 | B1 | 8/2001 | Ko | |
| 6,305,978 | B1 | 10/2001 | Ko | |
| 6,305,979 | B1 | * 10/2001 | Ko | 439/579 |
| 6,338,652 | B1 | 1/2002 | Ko | |
| 6,375,506 | B1 | * 4/2002 | Saunders et al. | 439/607 |
| D456,777 | S | 5/2002 | Igarashi | |
| D456,779 | S | 5/2002 | Igarashi | |
| D456,780 | S | 5/2002 | Igarashi | |
| D457,138 | S | 5/2002 | Igarashi | |
| 6,544,050 | B1 | * 4/2003 | Ko | 439/108 |
| 6,619,985 | B1 | * 9/2003 | Ko | 439/607 |

* cited by examiner

*Primary Examiner*—Dean A. Reichard
*Assistant Examiner*—Adolfo Nino
(74) *Attorney, Agent, or Firm*—Wei Te Chung

(57) ABSTRACT

A cable connector assembly (1) comprises a dielectric housing (2) defining a plurality of passageways therein, a plurality of contacts (3) with multi pitches for transmitting power and signals, a cable set (4), and a conductive shield (5). Each contact comprises a mating portion (31), and a tail portion (33) at an opposite end thereof. The cable set consists of a conductive grounding bar (41) and a plurality of power and signal wires **(40*a*, 40*b*). The wires are arranged at multi pitches for being soldered to the tail portions of corresponding power and signal contacts (3*a*, 3*b*). A tongue plate (22) protrudes forwardly from a lower portion of a mating surface (210) of the housing for mating with the complementary connector. A receiving space (27)** is defined in the rear of the housing for receiving the grounding bar. The passageways are defined at multi pitches for receiving the contacts and signal segments of the wires.

20 Claims, 8 Drawing Sheets

LOW PROFILE CABLE CONNECTOR ASSEMBLY WITH MULTI-PITCH CONTACTS

BACKGROUND OF THE INVENTION

1. Field of the Invention

The present invention generally relates to a cable connector assembly, and more particularly to a micro coaxial cable connector assembly having a relatively low profile and multi-pitch contacts.

2. Description of Related Art

A micro coaxial cable connector is widely used in the high frequency communication connector field and is required to terminate a coaxial multiconductor cable. U.S. Pat. No. 6,123,582 discloses such a cable connector assembly. The micro coaxial cable connector assembly includes first and second housing members, a cable set with a plurality of wires, upper and lower shield members, and a plurality of contacts. The first housing member has a tongue plate protruding forwardly from a middle portion of the front surface thereof. The upper and lower shield members attached onto the first housing member are engagingly jointed with each other and electrically contact with a shield of a mating connector. The cable set consists of the wires each having a signal segment and grounding segment, and a grounding bar soldered with the grounding segments of the wires. The cable set and the contacts are assembled in the second housing member. The second housing member together with the cable set and the contacts are then assembled to the first housing member. Plural pairs of spring fingers of the upper shield member, electrically engage with the grounding bar of the cable set to establish a grounding path.

The above-mentioned micro coaxial cable connector assembly achieves perfect electrical performance in normal use. However, there still remains room for decrease in the height of such a cable connector assembly and simplicity in the structure thereof.

Hence, it is desired to have an improved cable connector assembly that addresses the problems encountered in the prior art.

SUMMARY OF THE INVENTION

Accordingly, one object of the present invention is to provide a cable connector assembly having a relatively low profile and a relatively simple structure.

Another object of the present invention is to provide a cable connector assembly having multi-pitch contacts.

To achieve the above objects, a cable connector assembly in accordance with the present invention comprises a dielectric housing defining a plurality of passageways therein, a plurality of contacts with multi pitches for transmitting power and signals, a cable set, and a conductive shield attached to the dielectric housing for establishing a grounding path. Each contact comprises a mating portion at a free end for electrically contacting with a corresponding contact of a complementary connector, and a tail portion at an opposite end thereof. The cable set consists of a plurality of juxtaposed power and signal wires and a conductive grounding bar. Each wire has a conductive signal segment, and a grounding segment insulated from the signal segment and firmly jointed with the grounding bar. The wires are arranged at multi pitches for being soldered to the tail portions of corresponding power and signal contacts. The dielectric housing comprises a mating surface and a jointing surface opposite to the mating surface. A tongue plate protrudes forwardly from mating surface of the housing for mating with the complementary connector. A receiving space is defined in the rear of the housing for receiving the grounding bar of the cable set therein. The passageways defined through the dielectric housing are arranged at multi pitches for receiving the power and signal contacts and the signal segments of the power and signal wires which are soldered together.

Other objects, advantages and novel features of the invention will become more apparent from the following detailed description when taken in conjunction with the accompanying drawings.

DETAILED DESCRIPTION OF THE INVENTION

Figure 1:
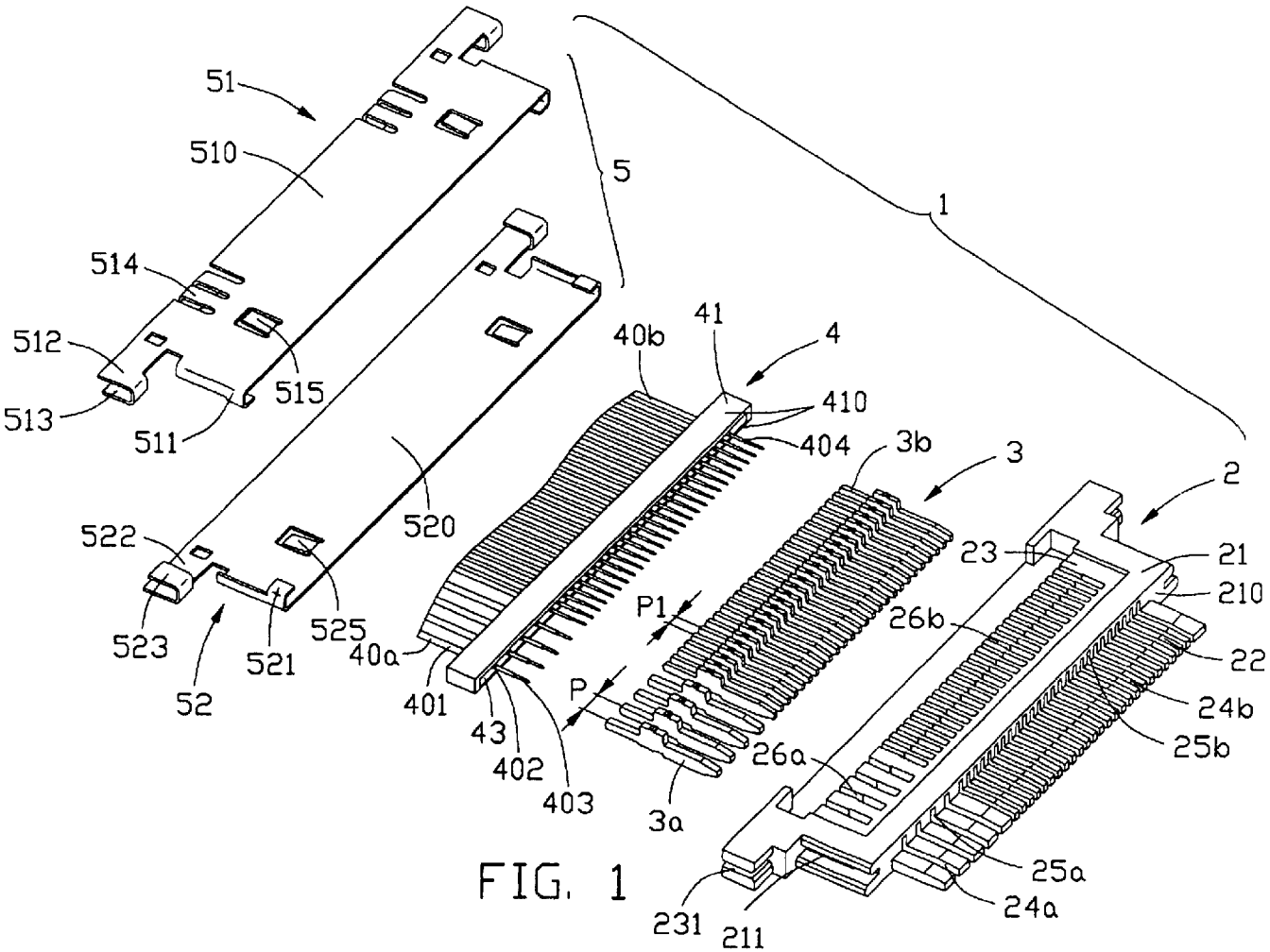
FIG. 1 is an exploded view of a cable connector assembly in accordance with the present invention.

Referring to FIG. 1, a cable connector assembly 1 in accordance with the present invention comprises a dielectric housing 2, a plurality of contacts 3, a cable set 4, and a metal conductive shield 5.

Figure 2:
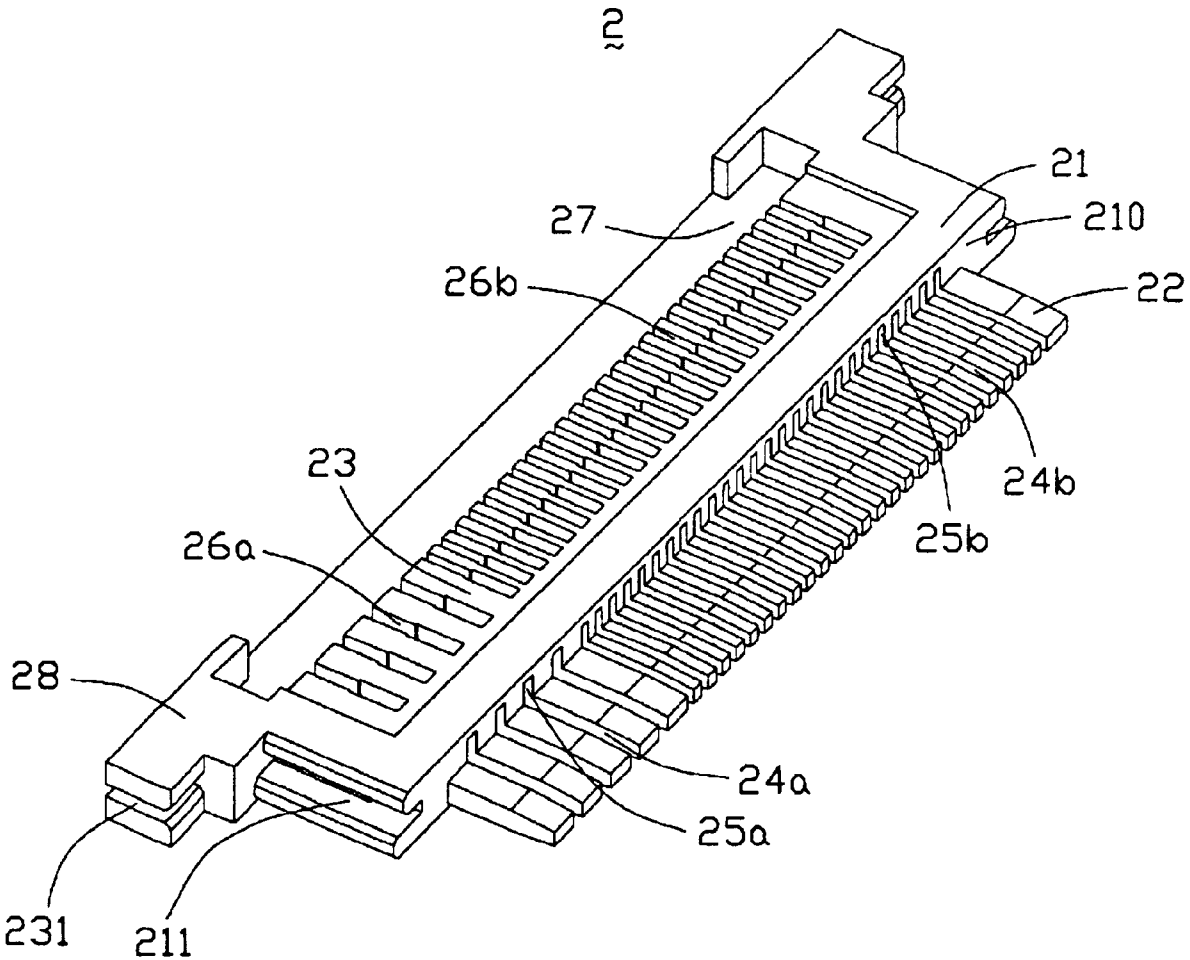
FIG. 2 is a perspective view of a dielectric housing of the cable connector assembly of FIG. 1.
Figure 3:
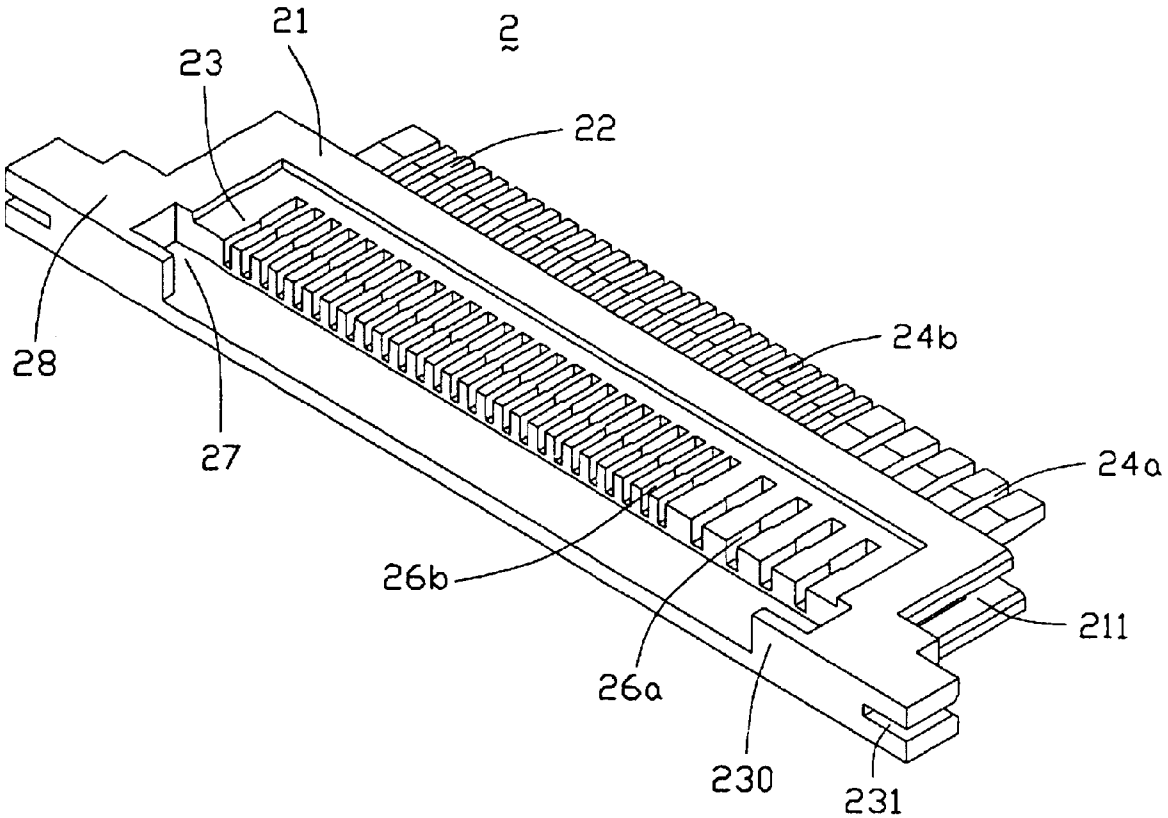
FIG. 3 is a view similar to FIG. 2, but viewed from a rear aspect.
Figure 7:
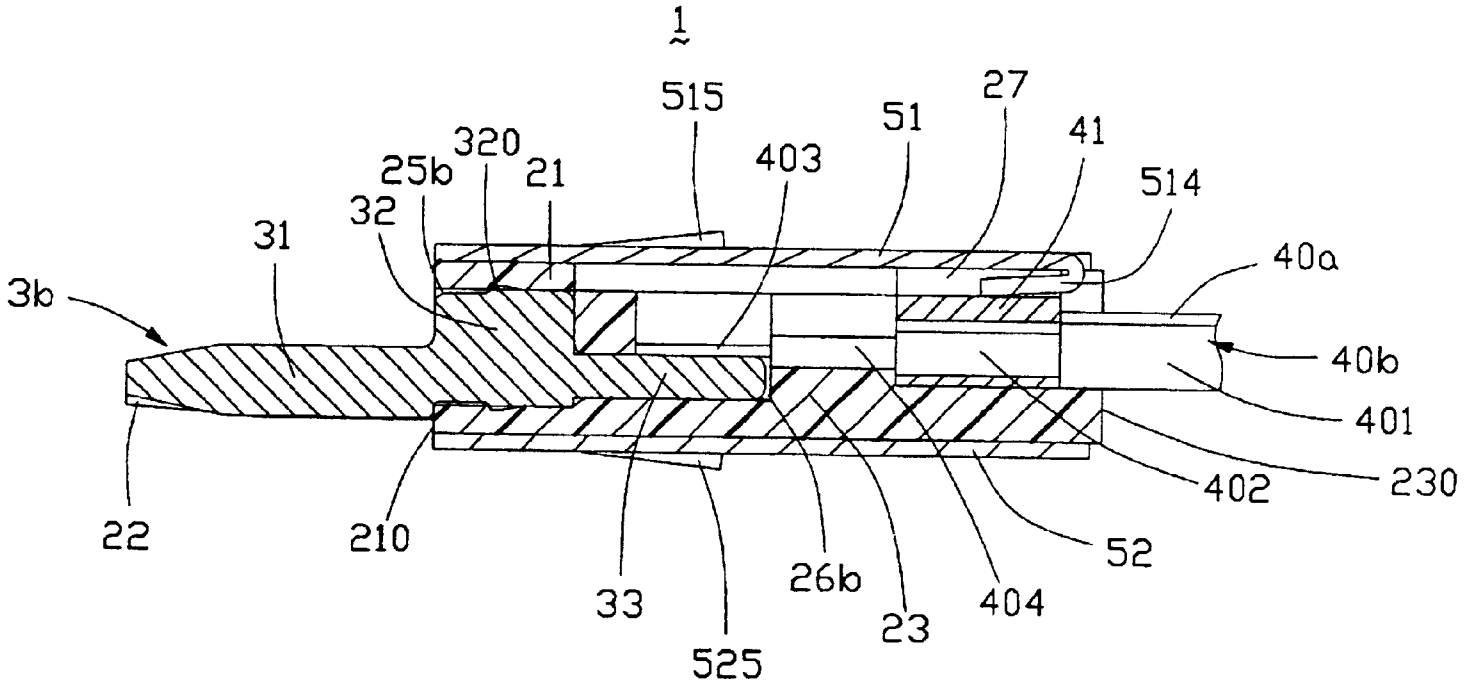
FIG. 7 is a cross sectional view of the cable connector assembly taken along line 7–7 of FIG. 6, illustrating a signal contact connecting with a corresponding signal wire of the cable set.
Figure 8:
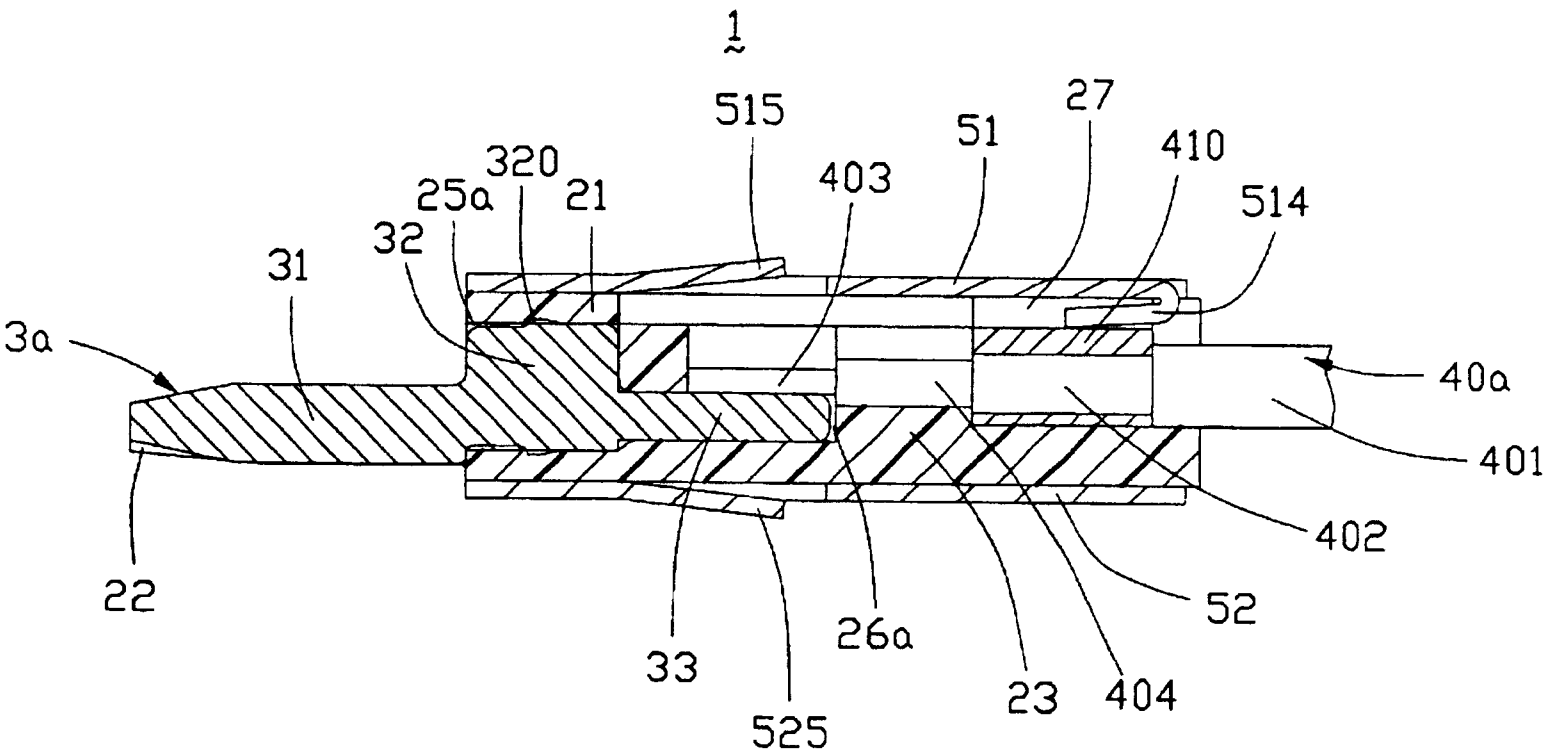
FIG. 8 is a cross sectional view of the cable connector assembly taken along line 8–8 of FIG. 6, illustrating a power contact connecting with a corresponding power wire of the cable set.

Referring to FIGS. 2 and 3 in conjunction with FIGS. 7 and 8, the dielectric housing 2 includes a rod 21 and a main portion 23 extending rearwardly from the rod 21. The housing 2 further includes a mating surface 210 and a jointing surface 230 opposite the mating surface 210. A tongue plate 22 projects forwardly from a lower portion of the mating surface 210 for inserting into a complementary connector (not shown). An ear portion 28 protrudes outwardly from each lateral side of the main portion 23. A receiving space 27 is defined in a rear portion of the main portion 23 and between the pair of ear portions 28 for receiving a corresponding portion of the cable set 4 therein. A plurality of passageways are defined through the dielectric housing 2 and comprises a plurality of wire-receiving passageways 26*a*, 26*b* defined in the main portion 23, a plurality of middle passageways 25*a*, 25*b* defined through the rod 21 in communication with the wire-receiving passageways 26*a*, 26*b*, and a plurality of contact-receiving slots 24*a*, 24*b* defined in the tongue plate 22 and communicating with corresponding middle passageways 25*a*, 25*b* defined in the rod 21. The wire-receiving passageways 26*a* are spaced from each other at a relatively large interval for receiving corresponding contacts 3 for power transmission. The wire-receiving passageways 26*b* are spaced from each other at a relatively small interval for receiving corresponding contacts 3 for signal transmission. So do the middle passageways 25*a*, 25*b* and the contact-receiving slots 24*a*, 24*b*. A front portion of each wire-receiving passageways 26*a*, 26*b* is relatively wide and deep for receiving a portion of a corresponding contact 3 therein. A pair of first recesses 211 and a pair of second recesses 231 are respectively defined in opposite lateral sides of the rod 21 and the main portion 23, and opposite lateral sides of the ear portions 28 for engaging with the shield 5.

Figure 4:
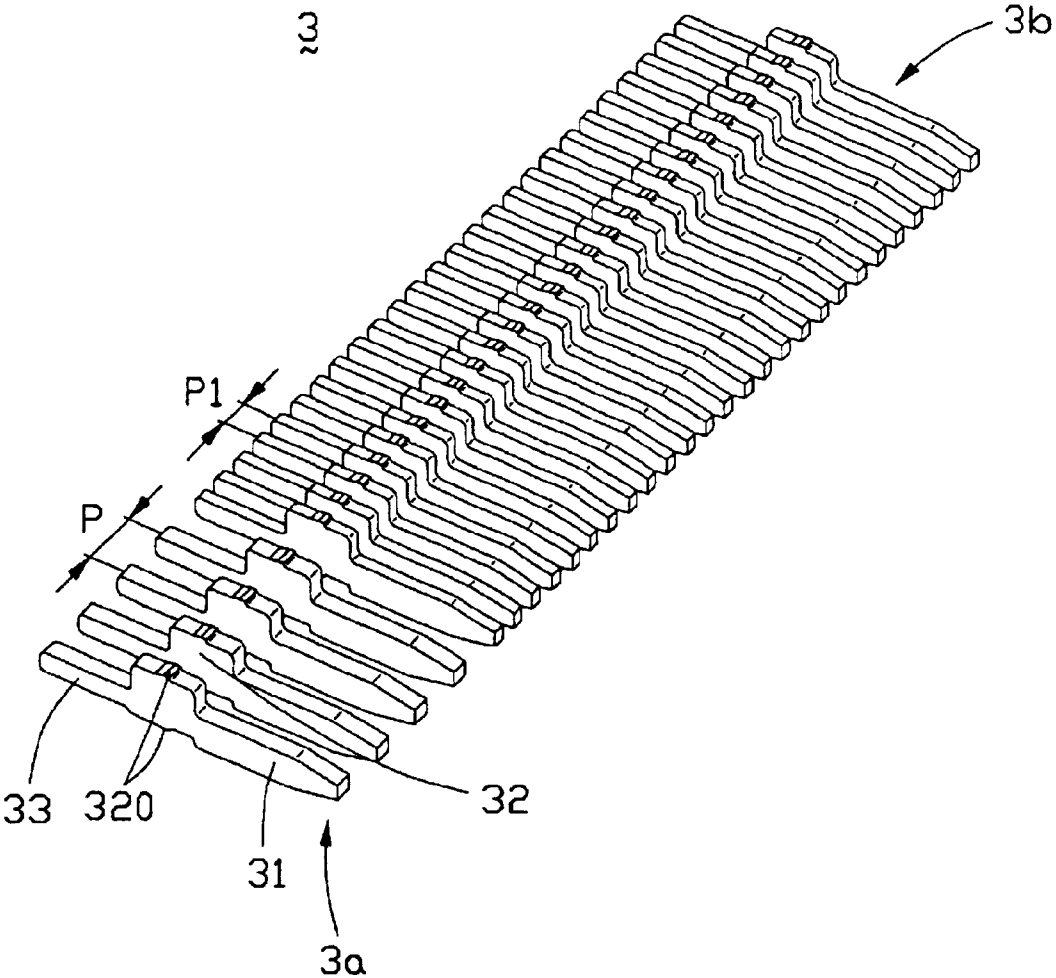
FIG. 4 is a perspective view of contacts of the cable connector assembly of FIG. 1.

Now referring to FIG. 4, a detailed description of the contacts 3 will be provided. The contacts 3 comprise a plurality of power contacts 3*a* spaced from each other at a relatively large pitch P for power transmission, and a plurality of signal contacts 3*b* spaced from each other at a relatively small pitch P1 for signal transmission. Each contact 3 includes a retention portion 32, a mating portion 31 extending forwardly from a lower portion of a front side of the retention portion 32 for mating with a corresponding contact of the complementary connector, and a tail portion 33 extending rearwardly from a lower portion of a rear side of the retention portion 32 for being soldered to the cable set 4. A plurality of barbs 320 is formed on upper and lower sides of the retention portion 32 for engaging with a corresponding middle passageway 25*a*, 25*b* defined in the rod 21.

The cable set 4 as shown in FIG. 1 includes a cable consisting of a row of juxtaposed round wires 40 and a conductive grounding bar 41. The wires 40 comprise a plurality of power wires 40*a* spaced from each other at a relatively large pitch for power transmission, and a plurality of signal wires 40*b* spaced from each other at a relatively small pitch for signal transmission. Each wire 40 is composed of a jacket 401 at the outmost thereof, a grounding layer 402 formed below the jacket 401, an insulative layer 404 formed below the grounding layer 402, and a conductive core 403 at the innermost thereof. The grounding bar 41 is defined with upper and lower metal plates 410 fixedly joined at opposite ends thereof and a crack 43 separating both metal plates 410 from each other. Each wire 40 extends through the crack 43 of the grounding bar 41 and is clamped between the plates 410. The outmost jacket 401 of each wire 40 is stripped off at a front end thereof to expose the grounding layer 402 as being a grounding segment of the wire 40. The grounding segment of each wire 40 is then respectively soldered with opposite inner surfaces of the upper and lower plates 410. The wire 40 in part is further stripped off to expose the conductive core 403 as being a signal segment or a power segment which extends outside the grounding bar 41 and is insulated from the grounding segment by the insulative layer 404.

Now referring to FIG. 1, the metal conductive shield 5 for providing grounding protection consists of upper and lower shells 51, 52. Each shell 51, 52 forms a plate portion 510, 520 with opposite bent flanges 511, 521. A pair of arms 512, 522 laterally extends from rear side edges of the plate portions 510, 520. A pair of claws 513, 523 is formed adjacent to corresponding bent flanges 511, 521. Each claw 513, 523 extends vertically from a front edge of a corresponding arm 512, 522 and is then bent rearwardly for engaging with the second recess 231 defined in the housing 2. Plural pairs of spring fingers 514 are bent downwardly and inwardly at a specific angle at a rear edge of the plate portion 510. A pair of tabs 515, 525 extends outwardly from the plate portion 510, 520 for electrical connection with a shield means of the complementary connector.

Figure 5:
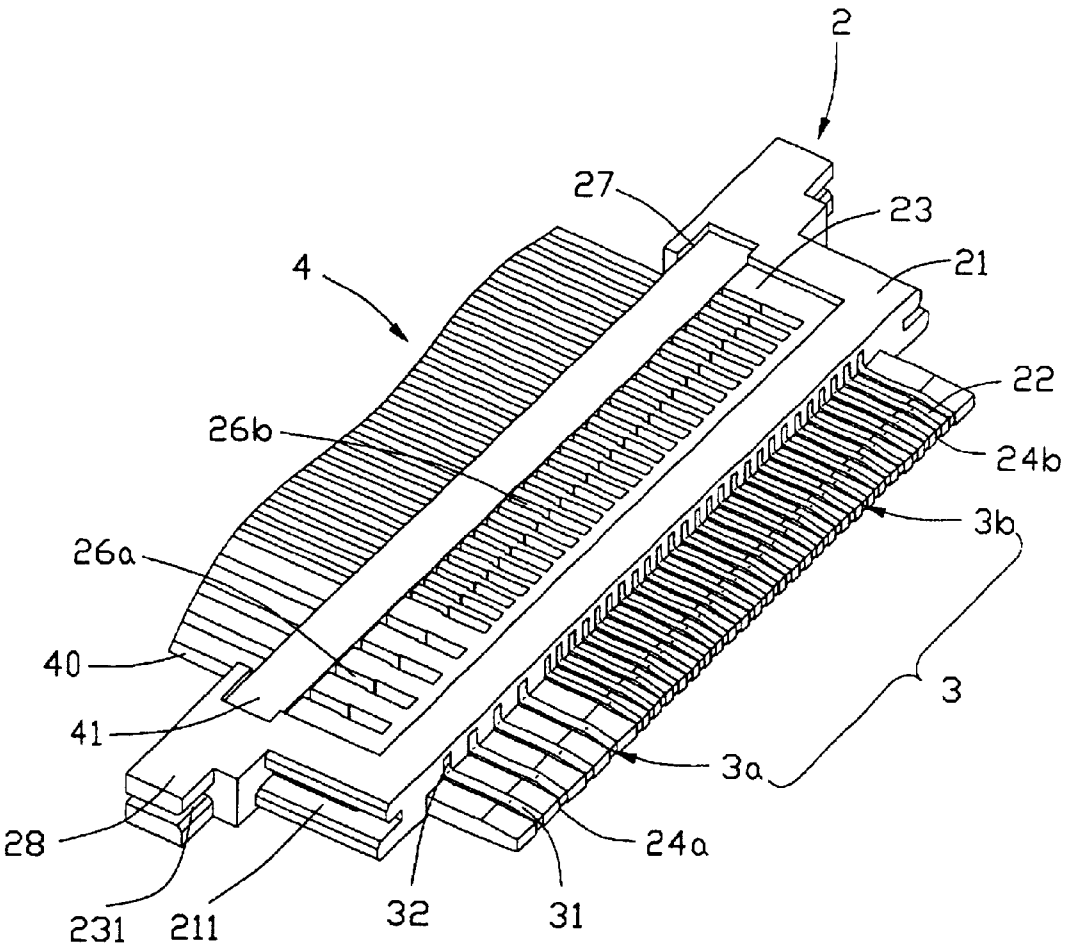
FIG. 5 is an assembled view of the housing, the contacts and a cable set of the cable connector assembly shown in FIG 1.

A subassembly of the housing 2, the contacts 3 and the cable set 4 is shown in FIG. 5 in conjunction with FIGS. 7 and 8. The power and signal contacts 3*a*, 3*b* are inserted into the dielectric housing 2 along a front-to-rear direction. The tail portions 33 and the retention portions 32 of the power and signal contacts 3*a*, 3*b* protrude through the contact-receiving slots 24 and are respectively received in the enlarged front portions of the wire-receiving passageways 26*a*, 26*b* and the middle passageways 25*a*, 25*b* defined in the rod 21. The barbs 320 of each retention portion 32 bite into upper and lower walls of a corresponding middle passageway 25*a*, 25*b*. The mating portions 31 of the power and signal contacts 3*a*, 3*b* are received in corresponding contact-receiving slots 24*a*, 24*b* and an upper surface of each mating portion 31 is slightly higher than that of the tongue plate 22 for electrically connecting with a corresponding contact of the complementary connector. The cable set 4 is then assembled to the housing 2 in a rear-to-front direction. The grounding bar 41 is received in the receiving space 27 defined in the rear of the main portion 23. The cable extends rearwardly out of the grounding bar 41 to link with a specific electrical device (not shown). The conductive cores 403 of the power and signal wires 40*a*, 40*b* horizontally enter into the front portions of corresponding wire-receiving passageways 26*a*, 26*b* and are soldered to upper surfaces of the tail portions 33 of corresponding power and signal contacts 3*a*, 3*b* for enhancement of the electrical and mechanical connection therebetween.

Figure 6:
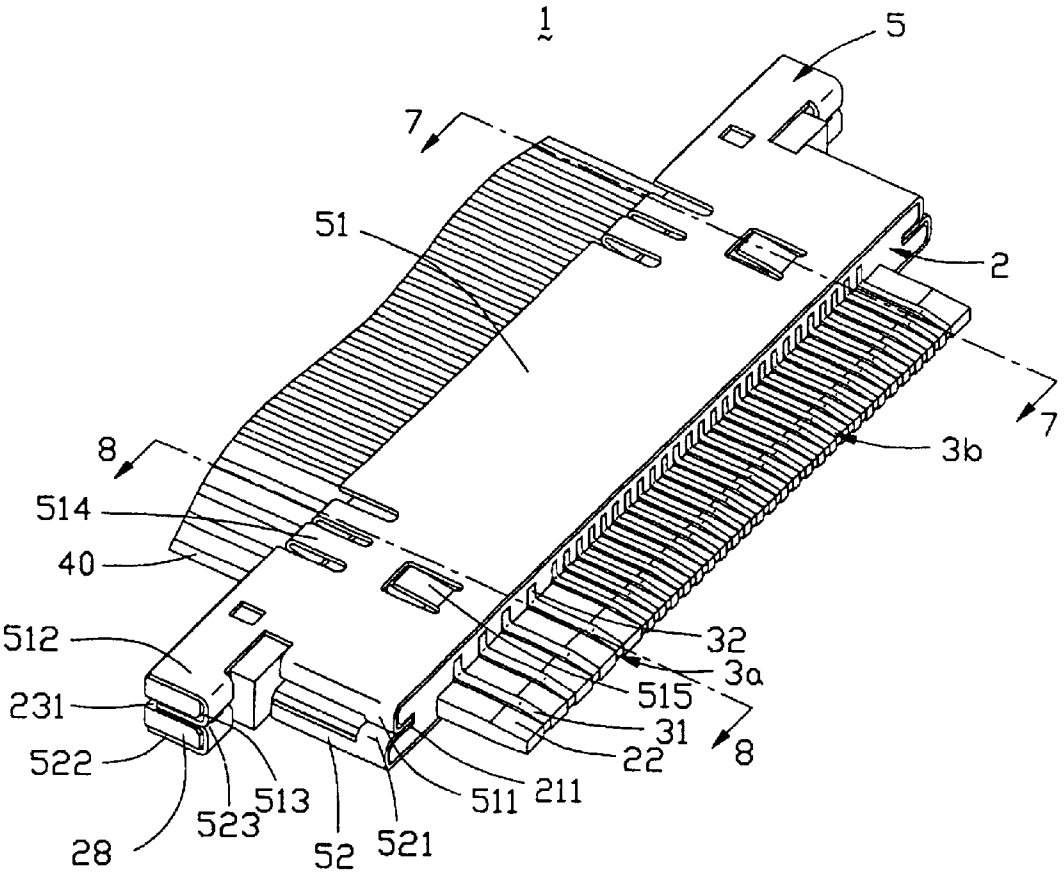
FIG. 6 is an assembled view of the cable connector assembly of FIG. 1.

In assembly of the shield 5 with the housing 2, as shown in FIGS. 6, 7 and 8, the upper and lower shells 51, 52 are separately attached onto the housing 2 along a front-to-rear direction, thereby covering the housing 2 except the surfaces 210, 230. The bent flanges 511, 521 of the upper and lower shells 51, 52 hook inwardly within the first recesses 211 and abut against each other. Likewise, the claws 513, 523 of the upper and lower shells 51, 52 hook rearwardly with the second recesses 231 defined in the opposite lateral sides of the ear portions 28. In the second recesses 231, the claws 513, 523 abut against each other. Therefore, an electrical engagement between both claws 513, 523 is established. Meanwhile, the spring fingers 514 of the upper shell 51 downwardly protrude into the receiving space 27 and are engagingly deflected upwardly by the upper plate 410 of the grounding bar 41. As a result, a ground path is built from the grounding layer 402 of each wire 40, through the grounding bar 41, the upper and lower shells 51, 52 contacting with each other by the claws 513, 523 and the bent flanges 511, 521, and the tabs 515, 525, to the shield means of the complementary connector.

The tongue plate 22 has a horizontal central plane vertically offset from a horizontal midline of the mating surface 210, and the mating portion 31 of each contact also has a horizontal central plane vertically offset from a horizontal midline of the front side of the retention portion 32. This decreases the height of the whole cable connector assembly 1. Multi pitches of the contacts 3 satisfy the need of transmitting power and signal together. Furthermore, the grounding bar 41 of the cable set 4 is received in the receiving space 27 of the housing 2, and the conductive cores 403 of the power and signal wires 40*a*, 40*b* are received in the corresponding wire-receiving passageways 26*a*, 26*b* defined in the main portion 23. Therefore, an additional rear housing member is not needed, which simplifies the structure of the connector assembly 1 and decreases the manufacturing cost thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for mating with an external complementary connector, comprising:

a plurality of power and signal contacts arranged at multi pitches, each contact having a mating portion at a free end thereof adapted for electrically contacting with a corresponding contact of the complementary connector, and a tail portion at an opposite end thereof;

a cable set comprising a plurality of juxtaposed power and signal wires each having a conductive signal segment and a grounding segment insulated from the signal segment, and a conductive grounding bar firmly jointed with the grounding segments of the wires, the wires being arranged at multi pitches for being soldered corresponding contacts;

a dielectric housing comprising a mating surface, a jointing surface opposite to the mating surface, a tongue plate protruding forwardly from the mating surface adapted for mating with the complementary connector, a receiving space defined in the rear thereof for receiving the grounding bar of the cable set therein, and a plurality of passageways defined therein at multi pitches in communication with the receiving space for receiving the power and signal contacts and the signal segments of the power and signal wires which are soldered together therein; and a conductive shield attached to the dielectric housing for establishing a grounding path.

2. The cable connector assembly as described in claim 1, wherein each contact comprises a retention portion connecting the mating portion with the tail portion, the mating portion extends forwardly from the retention portion and has a horizontal central plane vertically offset from a horizontal midline of affront side of the retention portion, and the tail portion extends rearwardly from the retention portion and has a horizontal central plane vertically offset from a horizontal midline of a rear side of the retention portion.

3. The cable connector assembly as described in claim 2, wherein the housing comprises a main portion and a rod forwardly extending from the main portion, the mating surface is provided on the rod, and the tongue plate has a horizontal central plane vertically offset from a horizontal midline of the mating surface of the rod.

4. The cable connector assembly as described in claim 3, wherein the passageways comprises a plurality of wire-receiving passageways defined in the main portion of the housing, a plurality of middle passageways defined through the rod of the housing, and a plurality of contact-receiving slots defined in the tongue plate.

5. The cable connector assembly as described in claim 4, wherein the retention portion of each contact has a plurality of barbs formed on upper and lower sides thereof.

6. The cable connector assembly as described in claim 5, wherein the middle passageways defined through the rod receive the retention portions of the contacts, and the barbs of the retention portions bite into upper and lower walls of the middle passageways.

7. The cable connector assembly as described in claim 4, wherein the wire-receiving passageways arranged at a relatively large pitch receive the tail portions of the power contacts and the signal segments of the power wires, and the wire-receiving passageways arranged at a relatively small pitch receive the tail portions of the signal contacts and the signal segments of the signal wires.

8. The cable connector assembly as described in claim 4, wherein the contact-receiving slots receive the mating portions of the contacts.

9. The cable connector assembly as described in claim 3, wherein the housing has a pair of ear portions protruding outwardly from respective opposite lateral sides of the main portion.

10. The cable connector assembly as described in claim 9, wherein the housing defines a pair of first recesses and a pair of second recesses respectively in opposite lateral sides of the main portion and the rod, and opposite lateral sides of the ear portions for engaging with the shield.

11. The cable connector assembly as described in claim 10, wherein the shield comprises upper and lower shells, each shell having a plate portion and opposite bent flanges hooking inwardly within the first recesses.

12. The cable connector assembly as described in claim 11, wherein each shell has a pair of arms extending from respective rear side edges of the plate portion, and a pair of claws extending vertically and then rearwardly from front edges of corresponding arms for hooking rearwardly within the second recesses.

13. The cable connector assembly as described in claim 11, wherein the upper shell has plural pairs of spring fingers bent downwardly at a rear edge thereof, and then inwardly extending into the receiving space and engagingly deflected upwardly by the grounding bar received therein.

14. The cable connector assembly as described in claim 11, wherein each plate portion has a pair of tabs extending outwardly therefrom adapted for electrical connection with a shield means of the complementary connector.

15. A cable connector assembly for mating with an external complementary connector, comprising:

a plurality of contacts each comprising a retention portion, a mating portion extending forwardly from a front side of the retention portion and having a horizontal central plane vertically offset from a horizontal midline of the front side of the retention portion, and a tail portion extending rearwardly from a rear side of the retention portion and having a horizontal central plane vertically offset from a horizontal midline of the rear side of the retention portion;

a cable set comprising a plurality of juxtaposed wires each having a conductive signal segment and a grounding segment insulated from the signal segment, and a conductive grounding bar firmly jointed with the grounding segments of the wires;

a dielectric housing comprising a mating surface, a jointing surface opposite to the mating surface, a tongue plate protruding forwardly from the mating surface and having a horizontal central plane vertically offset from a horizontal midline of the mating surface adapted for mating with the complementary connector, a receiving space defined in the rear thereof for receiving the grounding bar of the cable set therein, and a plurality of passageways defined therein for receiving the contacts and the signal segments of the wires which are soldered together therein; and a conductive shield attached to the dielectric housing, the shield having a spring finger downwardly extending into the receiving space and engagingly deflected upwardly by the grounding bar received therein, thereby establishing a grounding path from the grounding segments of the wires to the shield.

16. The cable connector assembly as described in claim 15, wherein the contacts comprises power contacts arranged at a relatively large pitch and signal contacts arranged at a relatively small pitch.

17. The cable connector assembly as described in claim 16, wherein the wires of the cable set comprises power wires soldered to corresponding power contacts for power transmission, and signal wires soldered to corresponding signal contacts for signal transmission.

18. The cable connector assembly as described in claim 15, wherein the housing comprises a main portion and a rod forwardly extending from the main portion, the mating surface is provided on the rod, and the tongue plate has a horizontal central plane vertically offset from a horizontal midline of the mating surface of the rod.

19. The cable connector assembly as described in claim 18, wherein each passageways comprises a wire-receiving passageway defined in the main portion for receiving the tail portion of a corresponding contact and the signal segment of a corresponding wire soldered with the tail portion of the corresponding contact, a middle passageway defined through the rod for receiving the retention portion of the corresponding contact, and a contact-receiving slot defined in the tongue plate for receiving the mating portion of the corresponding contact.

20. A cable connector assembly comprising:

a unitary dielectric housing defining opposite mating and joining faces thereof in a front-to-back direction;

a tongue plate extending forwardly from the mating face;

a receiving space defined around the joining face and open to an exterior in both vertical and horizontal directions relative to the housing;

a frame-like grounding bar assembled into and received in the receiving space in the vertical direction;

a plurality of contacts disposed in the housing;

a plurality of coaxial wires of a cable forwardly extending through the grounding bar and soldered on the corresponding contacts via inner conductors, respectively, an outer metallic braid of each of said wires being electrically connected to the grounding bar; and a metal shell attached to the housing, and mechanically and electrically connecting to and covering, in the vertical direction, said grounding bar.

* * * * *